US007801497B1

(12) United States Patent
Lam

(10) Patent No.: US 7,801,497 B1
(45) Date of Patent: Sep. 21, 2010

(54) FREQUENCY SCANNING RADIO MODULATOR AND METHOD

(75) Inventor: Alan M. L. Lam, Tai Po (HK)

(73) Assignee: RadioShack, Corporation, Fort Worth, TX (US)

( * ) Notice: Subject to any disclaimer, the term of this patent is extended or adjusted under 35 U.S.C. 154(b) by 601 days.

(21) Appl. No.: 11/810,535

(22) Filed: Jun. 6, 2007

(51) Int. Cl.
*H01Q 11/12* (2006.01)

(52) U.S. Cl. ..... 455/120; 455/3.01; 455/161.1; 455/161.2; 455/161.3; 455/182.1

(58) Field of Classification Search ..... 455/120, 455/3.01, 161.1, 161.2, 161.3, 182.1
See application file for complete search history.

(56) References Cited

U.S. PATENT DOCUMENTS 4,287,599 A * 9/1981 Goncharoff et al. ..... 455/77
5,842,119 A * 11/1998 Emerson et al. ..... 455/161.3
5,970,390 A 10/1999 Koga et al.
6,782,239 B2 8/2004 Johnson et al.
6,810,233 B2 10/2004 Patsiokas
6,856,798 B2 * 2/2005 Vitallo et al. ..... 455/345
2008/0076352 A1 * 3/2008 Der ..... 455/41.2

* cited by examiner

*Primary Examiner*—Sanh D Phu
(74) *Attorney, Agent, or Firm*—Dan Brown Law Office; Daniel R. Brown

(57) ABSTRACT

A radio modulator and method with a radio band scan function. The apparatus consists of a frequency selectable RF signal transmitter, a switch that couples the RF signal to an antenna, and a demodulator coupled to mix a received antenna signal with the RF signal to produce an indicia of signal strength at the receive frequency resulting from that mix. A channel memory is coupled to store plural indicia of signal strength values corresponding to plural receive frequencies. A controller is coupled to the transmitter, the switch, the channel memory, and a display. In operation, the controller enables the frequency scan function by decoupling the switch, tuning the transmitter RF signal to plural frequencies, which causes the demodulator to receive plural receive frequencies within the radio band. The controller also stores the resultant plural corresponding indicia of signal strength in the channel memory, and then compares the stored plural indicia of signal strength to select a present transmit frequency that has a low signal interfering level. Next, the controller couples the transmitter to the antenna, tunes the RF signal to the present transmit frequency, and displays the present transmit frequency on the display.

17 Claims, 8 Drawing Sheets

DC_VOLT
96
R10
C33
C32
RF_OUT
98
C26
MUTE
CHIP_DA
CHIP_CL
CHIP_E
C31
C30
XTAL1
C21
L1
C20
D1
C19
C18
C17
C15
C16
R20
TP2
C25
R21
R22
Q2
R19
C23
C22
R17
R18
Q1
R16
C14
C12
C11
R15
R14
C13
VR1
Q3
R12
BAND
94
R9
R8
R7
IC1
C10
C8
C6
C7
C5
C3
R6
C4
R4
C2
R2
R5
R3
C1
R1
88
90
LEFT_CHANNEL
92
RIGHT_CHANNEL
86

FREQUENCY SCANNING RADIO MODULATOR AND METHOD

BACKGROUND OF THE INVENTION

1. Field of the Invention

The present invention relates to radio modulators. More particularly, the present invention relates to a radio modulator that scan the FM broadcast band, searching for a transmit frequency with low ambient signal interference levels on which to subsequently transmit a modulated FM signal.

2. Description of the Related Art

Radio modulators are used to modulate base-band signals onto a radio carrier, and then transmit the modulated carrier to a nearby radio receiver. There are several types of commercial FM modulators available in the market, which typically operate as "Part 15" lower power devices. Such products are commonly called FM modulators or FM transmitters. FM modulators are employed to provide a wireless interface between the analog audio output of a portable audio playback device and an FM broadcast radio receiver. A common application for this type of product is to couple the audio output from an MP3 audio player to the FM radio receiver in an automobile, although many other applications are known.

The transmit frequency used by an FM modulator may be fixed or selected from a small number of predetermined frequencies, such as four or eight channels. Other prior art FM modulators allow selection of any of the one hundred FM station frequencies (i.e. 88.1 MHz to 107.9 MHz) allocated in the FM broadcast band. In each of these prior art FM modulators, the user manually selects the transmit frequency. A significant problem with this approach is that the frequency selected could be the same as, or close to, the frequency of the local FM broadcast radio station. As a result, detrimental interference occurs, which degrades the quality of the audio coupled from the FM modulator to the local FM radio receiver. The technique for avoiding such interference is to select a transmit frequency within the FM band that has a low ambient signal level, so the chance of interference is minimized. Unfortunately, this technique is frequently not understood or properly utilized by the casual end user of such products. Even in the case where the end user understands this selection process, the interference environment changes gradually as the FM modulator and radio move to a different geographic location.

The prior art has addressed the foregoing issue by implementing FM modulators that have an additional radio receiver circuit, which is used to check for ambient radio interference, and then recommends a transmit frequency to the user. For example, U.S. Pat. No. 5,970,390 to Koga et al. for TRANSMITTER AND AUTOMOBILE AUTO APPARATUS USING THE SAME teaches an FM transmitter that includes a transmitter circuit for converting the audio signal derived from an audio appliance into an FM signal within an FM broadcasting band to thereby transmit the FM signal. Kogal et al. includes a receiver circuit with a tuner unit, a display for displaying thereon a frequency, and a control circuit for controlling a transmission frequency of the transmitter circuit and the reception frequency of the receiver circuit. The control circuit causes the receiver circuit to detect an unused frequency within the FM broadcasting band and to set a frequency corresponding to the detected unused frequency to the transmission frequency, and also causes the display to display thereon the set transmission frequency. The implementation of this teaching requires a full receiver and a full transmitter circuit. Also, Koga et al. do not teach scanning the entire FM radio band, rather it teaches that the receiver increment until a suitably quiet frequency is identified. An absolute signal level threshold is therefore used as a reference.

Another prior art teaching is U.S. Pat. No. 6,782,239 to Johnson et al. for WIRELESS OUTPUT INPUT DEVICE PLAYER. Johnson et al. teach a wireless output and input device digital audio player that stores and/or receives digital audio, and then translates the stream to analog prior to modulation and transmission. The Johnson et al. device includes a full FM receiver circuit and a full FM transmitter circuit for transmitting the audio to an external FM radio or receiver. The device automatically and periodically scans a plurality of channels on the FM band to determine a channel having the least amount of interference and then tunes the FM transmitter to the frequency of that channel and displays the channel to which the external receiver should be tuned. The Johnson et al. device scans about fifteen frequencies. Signal quality is determined using a signal to noise ratio ("SNR") test that integrates the received noise over time and compares that with the peak signal level during that time period to establish an SNR value, which is stored. This takes considerable time, and requires an absolute threshold level detection process.

While the prior art teachings address certain issues regarding the selection of a suitable transmit frequency for use in an FM modulator, there are other issues remaining. The prior art teachings require the implementation of a full receiver circuit in addition to the transmitter circuit. This increases circuit complexity, cost and size of the apparatus. The prior art also employ absolute signal threshold level detection technique that doesn't adapt well to the vagaries of the radio environment, such as a city versus a rural environment. Thus it can be appreciated that there is a need in the art for an improved radio modulator that scans the entire radio band seeking the best channel or frequency on which to transmit.

SUMMARY OF THE INVENTION

The need in the art is addressed by the apparatus and methods of the present invention. The present invention teaches a radio modulator with a radio band scan function. The apparatus consists of a frequency selectable RF signal transmitter, a switch that couples the RF signal to an antenna, and a demodulator coupled to mix a received antenna signal with the RF signal to produce an indicia of signal strength at the receive frequency resulting from that mix. A channel memory is coupled to store plural indicia of signal strength values corresponding to plural receive frequencies. A controller is coupled to the transmitter, the switch, the channel memory, and a display. In operation, the controller enables the frequency scan function by decoupling the switch, tuning the transmitter RF signal to plural frequencies, which causes the demodulator to receive plural receive frequencies within the radio band. The controller also stores the resultant plural corresponding indicia of signal strength in the channel memory, and then compares the stored plural indicia of signal strength to select a present transmit frequency that has a low signal interfering level. Next, the controller couples the transmitter to the antenna, tunes the RF signal to the present transmit frequency, and displays the present transmit frequency on the display.

In a specific embodiment, the foregoing apparatus further includes an actuator coupled to the controller such that actuation of the actuator initiates the frequency scan function. In another embodiment, the apparatus includes a demodulator power source switch that is coupled to the controller such that the controller decouples power to the demodulator while the RF signal is coupled to the antenna.

In a specific embodiment of the foregoing apparatus, wherein the radio band is the commercial FM broadcast band, the controller sequentially tunes the entire FM broadcast band in 200 kHz increments. In another embodiment, the indicia of signal strength is a DC voltage level proportional to the receive frequency signal level. In another embodiment, the switch is a diode that is reverse-biased to decouple the RF signal from the antenna.

In a specific embodiment, the foregoing apparatus further includes an audio signal input that is coupled to provide a base band signal to the transmitter, and that is adapted to interface with a portable audio signal playing device. In another embodiment, the apparatus further includes a power supply circuit with a power input connector that is coupled to provide electric power the radio modulator apparatus. In a refinement to this embodiment, the transmitter is supplied power continuously while the power input connector is coupled to an external power supply. In another refinement, where the apparatus further includes an audio signal input and an input connector, the power supply circuit couples operating power through the input connector, for use in powering a portable audio player connected to the input connector.

The present invention teaches a method of scanning a radio band using a radio modulator having a frequency selectable RF signal transmitter, an antenna, a demodulator, a display, and a channel memory. The method includes the steps of scanning plural receive frequencies in the radio band, selecting a present transmit frequency from amongst the plural receive frequencies, and enabling the present transmit frequency for operation. The scanning operation specifically includes decoupling the RF signal from the antenna, tuning the RF signal transmitter to plural frequencies, mixing a received antenna signal with each of the plural RF signal frequencies in the demodulator and producing an indicia of signal strength at each of plural receive frequencies resulting from the mixing, and storing the plural indicia of signal strength in the channel memory at locations corresponding to plural receive frequencies. The selecting a present transmit frequency operation specifically includes comparing the stored plural indicia of signal strengths, selecting one of the plural receive frequencies, based on a low stored indicia of signal strength, as a present transmit frequency. The enabling the present transmit frequency operation specifically includes coupling the RF signal to the antenna, tuning the RF signal transmitter to the present transmit frequency, and displaying the present transmit frequency.

In a specific embodiment, the foregoing method includes the further step of actuating an actuator to manually initiate the scanning, selecting and enabling steps. In another embodiment, the method includes the further steps of connecting power to the demodulator in preparation for the scanning sequence, and disconnecting power from the demodulator in preparation for the enabling sequence.

In a specific embodiment of the foregoing method, wherein the radio band is the FM broadcast band, the sequence of tuning the RF signal transmitter to plural frequencies further includes sequentially tuning entire FM broadcast band in 200 kHz increments. In another specific embodiment, the indicia of signal strength is a DC voltage level proportional to the receive frequency signal level. In another embodiment, the foregoing method additionally includes manually selecting the present transmit frequency. In another embodiment, the method includes maintaining electrical power to the RF signal transmitter during all of the recited method steps.

DESCRIPTION OF THE INVENTION

Figure 1:
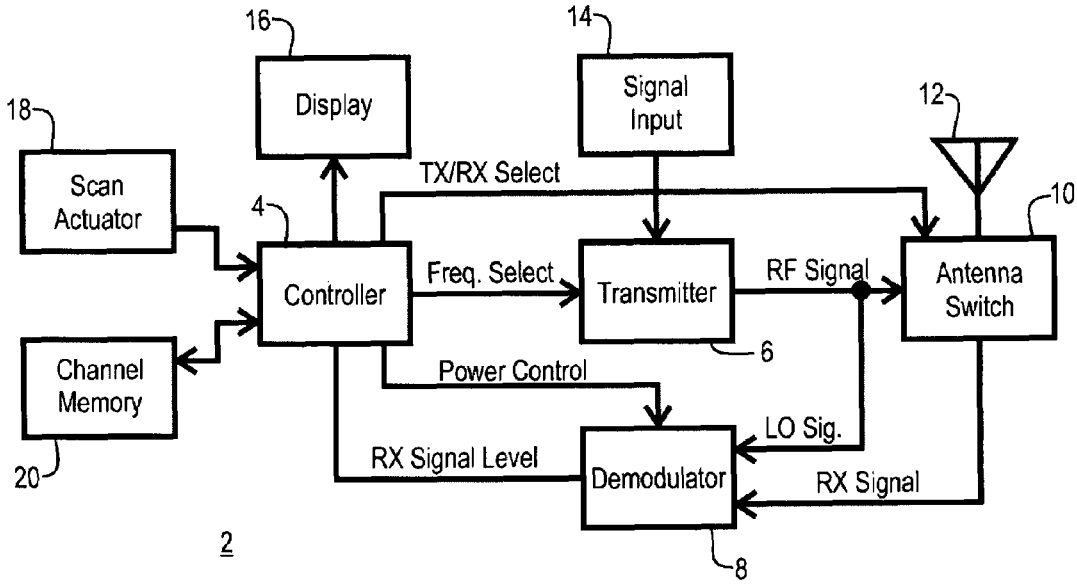
FIG. 1 is a functional block diagram of a frequency scanning radio modulator according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods and components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

As noted hereinbefore, a common problem with prior art FM modulators occurs when the selected transmit frequency coincides with a local broadcast FM station, producing detrimental interference. A technique for avoiding such interference is to select a transmit frequency within the FM band that has a low ambient signal level, indicating the absence of a local broadcast station. The prior art has introduced the concept of incorporating a receiver in the radio modulator that is used to check for signal interference of a candidate transmission frequency, however, there are several problems that have not been addressed by the prior art. The prior art teaches the use of separate transmitter and receiver circuits to accomplish that objective. This requires more circuit components and certain control complexities so as to prevent the powerful transmitted signal from interfering with the receiver functions. Similarly, the receiver can produce spurious emissions that are detrimental to the transmission functions. The present invention teaches the use of an antenna switch to disconnect the transmitted signal from the antenna, and then uses the transmitter circuit as the local oscillator for a scanning receiver. This is simpler and a lower cost approach than applied in the prior art, yet it provides a better solution in terms of locating the best available transmission frequency. In an illustrative embodiment of the present invention, the antenna switch is a low cost diode that is forward biased to couple the transmitter to the antenna, and reverse biased to isolate it. A single antenna can thus be used for both reception and transmission functions, although, the use of separate antennas is not precluded. Additionally, in the illustrative embodiment, the detector circuit is energized only during the receive functions, so that it produces no harmful radio interference during the transmit mode of operation.

An illustrative embodiment of the present invention provides an optimal solution to the FM interference problem in the prior art by scanning the entire one hundred channel FM band to locate a quiet frequency of operation in response to a user activated command. The illustrative embodiment utilizes an FM detector to produce a DC voltage level output proportional to the received ambient signal level. The scan and detection process occurs quickly, scanning the entire band, although other embodiments may scan a smaller fraction of the band. At each increment, a controller receives the detected voltage level and stores the value of the voltage level in a channel memory. Once the scan is complete, the controller compares the stored values and selects a frequency with a low, or the lowest, ambient signal level, indicating that the frequency is unused by a local broadcast station. The transmitter is then tuned to that frequency and the frequency is also displayed on a display. The user reads the display and manually tunes the vehicle radio to that frequency. If interference later arises, the user can initiate the scan process again to identify a new present frequency of operation.

Reference is directed to FIG. 1, which is a functional block diagram of a frequency scanning radio modulator 2 according to an illustrative embodiment of the present invention. In the transmit mode of operation, a signal input 14 receives a base band signal that is coupled to a radio transmitter 6, which modulates the base band signal onto an radio frequency (hereinafter "RF") signal. The RF signal may be radiated by an antenna 12 as an RF carrier. An antenna switch 10 is disposed between the transmitter 6 output and the antenna 12, and serves to either couple or decouple the RF signal to the antenna 12. A controller 4, which is a typical dedicated control microcontroller as are known to those skilled in the art, outputs a frequency selection signal to the transmitter 6. This enables selective tuning of the RF signal frequency. In addition, the controller 4 is coupled to the antenna switch 10 to facilitate the aforementioned antenna 12 coupling and decoupling selection. Thus, in the transmit mode of operation, the antenna switch is placed in the 'coupled' state and the signal input 14 is modulated onto an RF signal by the transmitter 6, and radiated as a radio carrier by the antenna 12.

The controller 4 in FIG. 1 is coupled to a scan actuator 18. Actuation of the scan actuator 18 enables a radio band scan process by the modulator 2, which operates as follows. Upon actuation of the scan actuator 18, the controller 4, through execution of corresponding object code software embedded therein, connects electric power to a modulator circuit 8, toggles the antenna switch to a decoupled state, thereby disconnecting the RF signal from the antenna 12. The antenna 12 is still exposed to the environment and therefore receives ambient radio signals within the radio band of interest. These received signals are coupled to the receiver ("RX") signal input of the radio demodulator 8. In addition, the RF signal output from the transmitter 6 is input to the demodulator 8 as a local oscillator ("LO") signal. Note that the controller 4 selectively controls the RF signal (and LO signal) frequency according to a frequency plan applicable to the radio band of interest. These two signals are mixed in the demodulator 8 and thus a selected receive signal within the radio band of interest is demodulated. The demodulator 8 provides a received signal level output to the controller 4. This is a signal strength indictor for the receive frequency presently demodulated, as determined by the LO signal and the RF signal frequencies input to the demodulator 8. The controller 4 stores an indicia of the RX signal level in a channel memory 20 indexed, or addressed, according to each of the presently received frequencies. The controller 4 increments, or sequences, through plural channels (frequencies) within the radio band of interest, and stores the indicia of signal strength for each. Once the scan is complete, the controller 4 compares the plural stored indicia to select a frequency according to predetermined criteria, which generally indicates a low level of ambient signal interference. For example, the weakest signal indicia can be selected. The antenna switch is then toggled to the 'coupled' condition, the electric power to the demodulator 8 is disconnected, and the transmitter 6 is tuned to the presently selected frequency. In addition, the presently selected frequency is displayed on a display 20, so that the user can tune the receiving radio terminal to the radio carrier frequency presently being broadcast.

Figure 2:
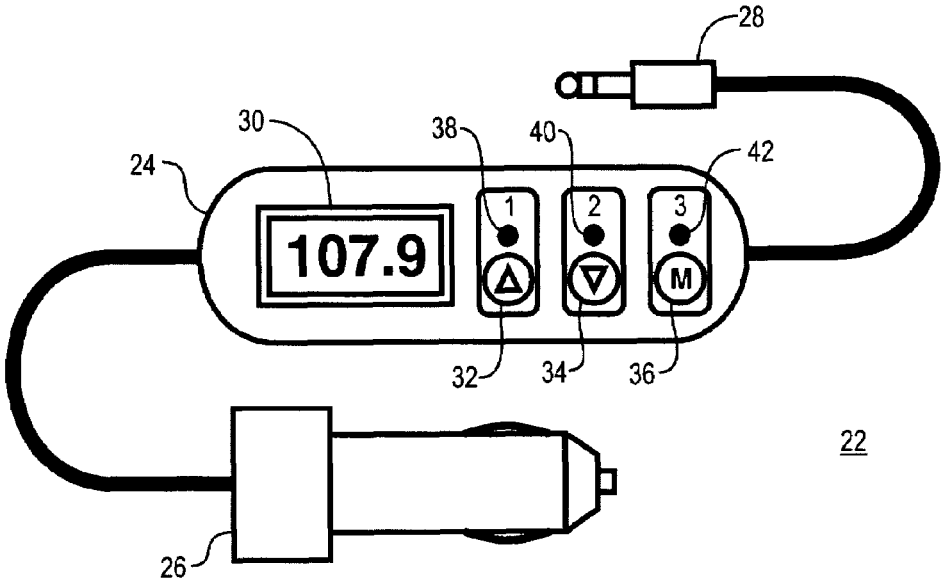
FIG. 2 is a drawing of a frequency scanning radio modulator according to an illustrative embodiment of the present invention.

Reference is directed to FIG. 2, which is a drawing of a frequency scanning radio modulator 22 according to an illustrative embodiment of the present invention. The illustrative embodiment of FIG. 2 is directed to a scanning radio modulator useful in the US commercial FM broadcast band from 88.1 MHz to 107.9 MHz, allocated as one hundred channels, spaced at 200 kHz intervals by the Federal Communications Commission under authority of Title 47 of the United States Code. The apparatus 22 includes a housing 24 that contains the various circuit components of the embodiment and presents a present transmit frequency display 30 on its exterior. Three actuators 32, 34, 36 and three indicator lights 38, 40, 42 are also presented on the exterior of the housing 24. These user interface items enable initiation of the scan function, manual selection of a present transmit frequency, and other operational controls of the modulator 22. Power is supplied to the modular 22 through a cable connected cigarette lighter adapter (hereinafter "CLA") plug, as are known to those skilled in the art for acquiring twelve volt DC power from the electrical system of a motor vehicle. Base band signals are input to the modulator using a cable connected miniature stereo audio plug 28, as are know to those skilled in the art. Any other suitable base band signal connector can readily be adapted to the teachings of the present invention.

Figure 3:
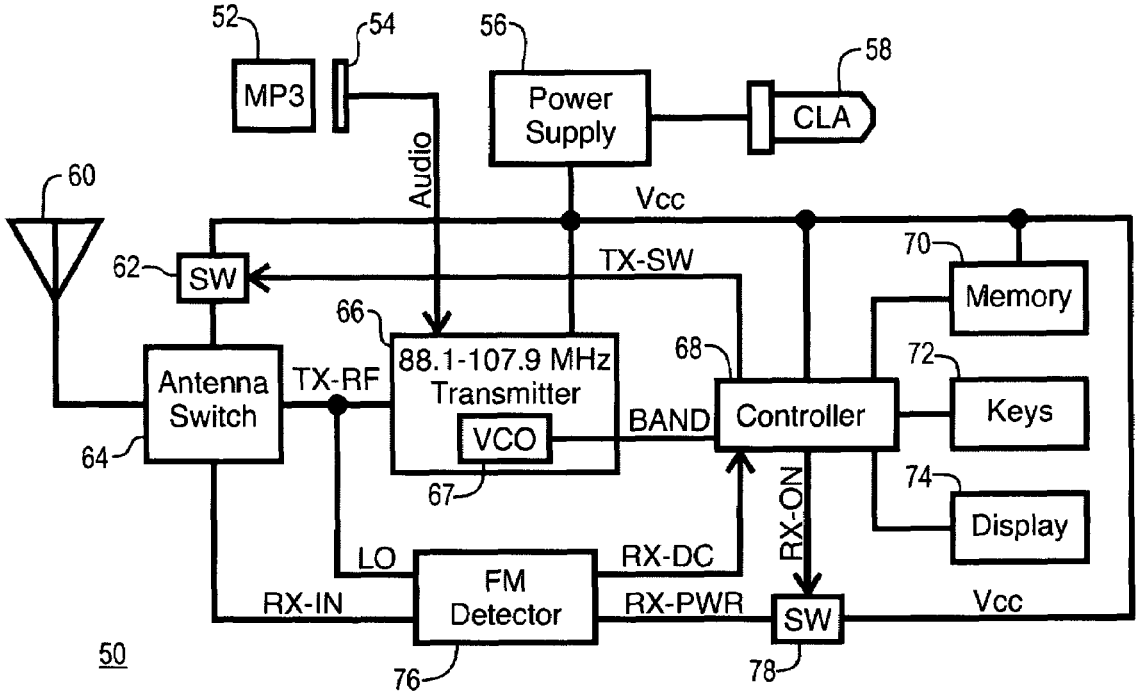
FIG. 3 is a functional block diagram of a frequency scanning FM radio modulator according to an illustrative embodiment of the present invention.

Reference is directed to FIG. 3, which is a functional block diagram of a frequency scanning FM radio modulator 50 according to an illustrative embodiment of the present invention. The illustrative embodiment of FIG. 3 is another commercial FM broadcast radio modulator. A selectively tunable transmitter circuit 66 operates in the FM broadcast band of 88.1 MHz to 107.9 MHz, and is used to modulate and transmit the stereo audio signal coupled from an MP3 music player 52 through a suitable interface connector 54. The transmission occurs in accordance with the well known FM multiplex stereo broadcast format. The frequency of operation is selected by a controller 68, which outputs a BAND signal to a voltage controlled oscillator (hereinafter "VCO") 67 in the radio transmitter 66. The modulator derives power through a CLA plug 58 that draws on a host vehicle electrical system to drive a regulated DC power supply 56, which provides the modulator's supply voltage (Vcc). The controller 68 also performs the illustrative embodiment scanning process of the entire FM radio band to locate a quiet frequency of operation, which occurs in response to a user actuation of an input actuator 72. The modulator utilizes an FM detector circuit 76 to produce a DC voltage level output ("RX-DC") proportional to the received ambient signal level. The DC output voltage (RX-DC) results from combining the transmitter 66 RF oscillator frequency ("TX-RF") with the received signal ("RX-IN) from the antenna 60. The controller 66 sequentially steps the VCO 67 through ninety-nine 200 kHz steps in the FM band (88.1 MHz to 107.9 MHz). At each increment, the controller 68 receives the detected RX-DC voltage level and stores the value of the voltage level in a channel memory 70. Once complete, the controller 68 compares the stored values and selects a frequency with a low ambient signal level, indicating that the frequency is unused by a local broadcast station. The transmitter 68 is tuned to that frequency and also displays it on a display 74. The user reads the display and manually tunes the vehicle radio to that frequency, such that the wireless link is established absent objectionable interference. If interference later arises, the user can initiate the scan process again to identify a new frequency of operation.

Control of the antenna switch 64 is managed using a transistor switch 62 under controller of a TX-SW signal from controller 68 to either forward bias or reverse bias a coupling diode (not shown) in the antenna switch 64. Similarly, DC power to the FM demodulator 76 is controlled using a transistor switch 78 via an RX-ON signal from controller 68. It will be appreciated that separate transmitter and receiver circuits could have been used to facilitate the transmit and receive/scan functions of the modulator 50.

Figure 4:
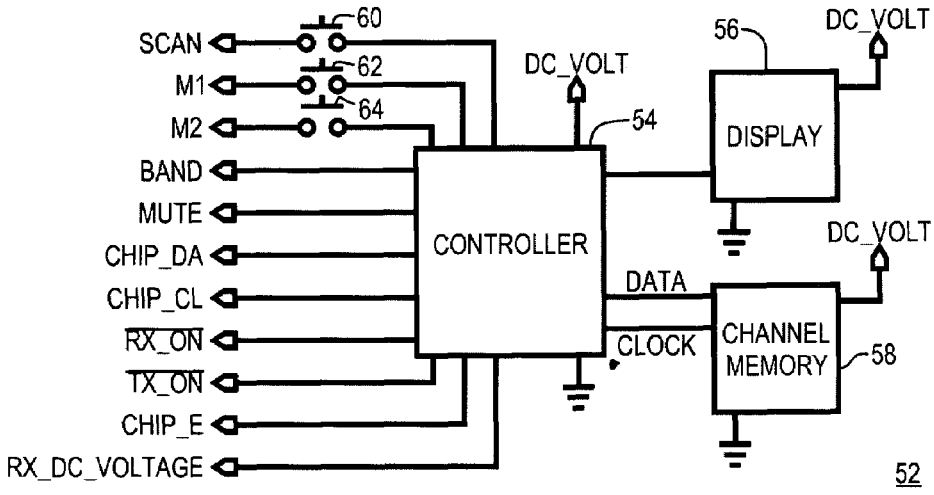
FIG. 4 is a schematic diagram of a controller, display, and channel memory circuit in a frequency scanning radio modulator according to an illustrative embodiment of the present invention.

Reference is now directed to FIG. 4 through FIG. 10, which are schematic drawings of the various sub-circuits of an illustrative embodiment of the present invention, which when combined, illustrate a single apparatus of the embodiment. FIG. 4 is a schematic diagram of a controller 54, display 56, and channel memory circuit 58 in a frequency scanning radio modulator 52 according to the illustrative embodiment of the present invention. The controller 54 is an embedded dedicated microcontroller, as are known to those skilled in the art to be suitable for low-power portable electronic devices. The input actuators 60, 62, and 64 are contact closures to inputs on the controller 54, and are used to effect user inputs and controls to the apparatus, including initiation of the channel scanning functions. The various controller input and output signals are listed adjacent to the illustrated signals lines, and correspond to the subsequent drawing figures where they are repeated. Note that the channel memory 58 uses a serial interface in the illustrative embodiment, however, any suitable memory device known to those skilled in the art could be employed under the teachings of the present invention.

Figure 5:
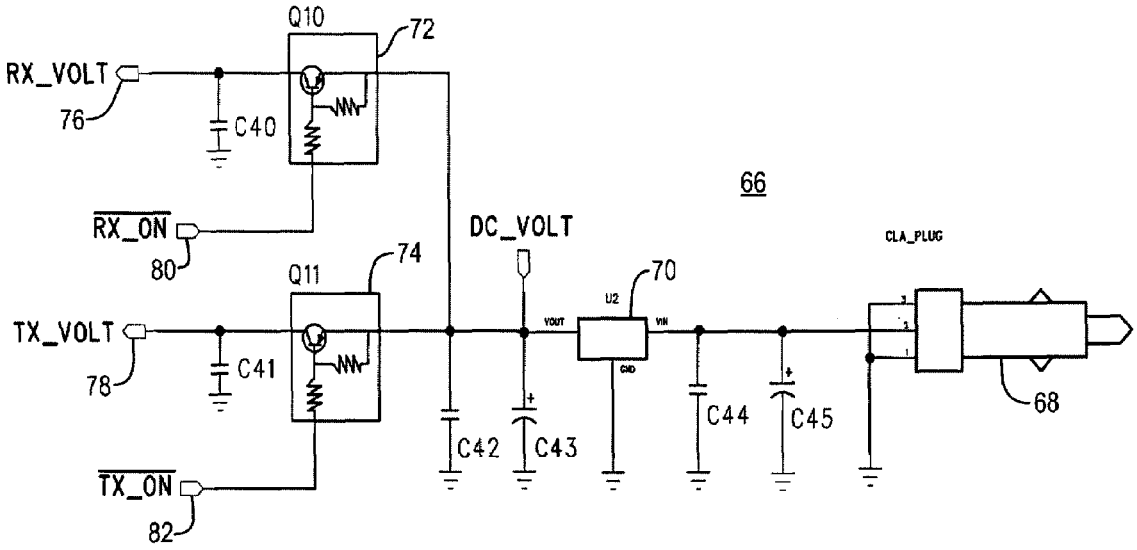
FIG. 5 is a schematic diagram of a power supply circuit in a frequency scanning radio modulator according to an illustrative embodiment of the present invention.

Reference is directed to FIG. 5, which is a schematic diagram of a power supply circuit 66 in a frequency scanning radio modulator according to the illustrative embodiment of the present invention. A CLA plug 68 is used to draw power from the host vehicle electrical system. Vehicle power is applied to an integrated voltage regulator 70, which delivers the regulated DC_VOLT power supply to the various circuits in the modulator. FIG. 5 also illustrated the demodulator power switch transistor 72 and the antenna switch control transistor 74. With respect to the demodulator switch 72, an active-low RX_ON signal 80 from the controller 54 drives the switch 72 to selectively power RX_VOLT 76 to the demodulator. Thus, the RX_ON signal 80 enables the controller 54 to switch power to the demodulator on and off. Similarly, and active-low TX_ON signal 82 from the controller 54 drives the antenna switch 74 to selectively power TX_VOLT 78 to the demodulator (not shown in this Figure). TX_VOLT 78 is used to forward bias a diode in the antenna switch (not shown), which serves to couple and decouple the antenna. Thus, the TX_ON signal 82 enables the controller 54 to control the antenna switch between a coupled state and a decoupled state.

Figure 6:
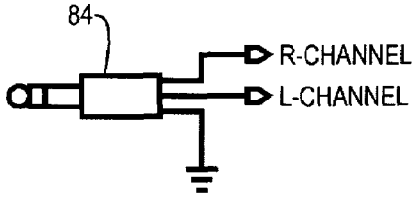
FIG. 6 is a schematic diagram of the audio input circuit in a frequency scanning radio modulator according to an illustrative embodiment of the present invention.

Reference is directed to FIG. 6, which is a schematic diagram of the audio input circuit in a frequency scanning radio modulator according to the illustrative embodiment of the present invention. A miniature stereo plug 84 is adapted to couple to an audio playback device to interface the right channel (R-CHANNEL) and left channel (L-CHANNEL) base band audio signals. The plug 84 can be replaced or adapted to suit a wide array of audio sources, such as portable radios, MP3 players, tape players, CD players and so forth, and which may include standardized audio signal interfaces or proprietary interfaces.

Figure 7:
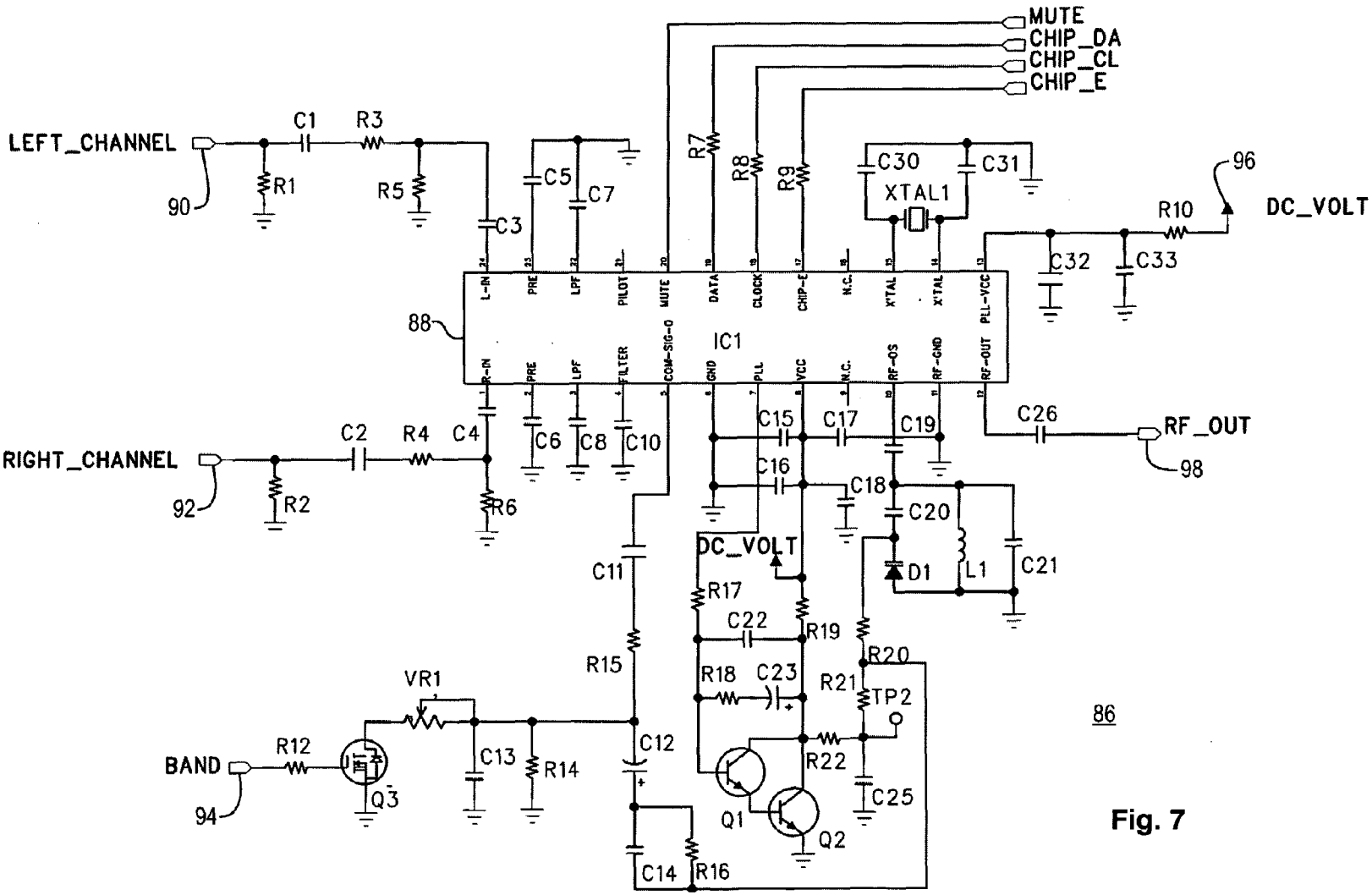
FIG. 7 is a schematic diagram of an FM transmitter circuit in a frequency scanning radio modulator according to an illustrative embodiment of the present invention.

Reference is directed to FIG. 7, which is a schematic diagram of an FM transmitter circuit 86 in a frequency scanning radio modulator according to an illustrative embodiment of the present invention. Integrated circuit "IC1" 88 is a FM transmitter, of the type that is known to those skilled in the art. Power to the overall FM transmitter circuit 86 is continually supplied from the DC_VOLT 96 power line. The FM transmitter integrated circuit 88 is connected to an external VCO component and an FM deviation control circuit such that analog audio signals can be modulated on an RF signal and output as RF_OUT 98, which is coupled though the antenna switch (not shown) to the antenna (not shown). The VCO circuit is constructed by components; inductor L1, varactor D1, capacitor C20 and capacitor C21. The FM deviation control part is constructed using variable resistor VR1, capacitor C13, Resistor R14 and capacitor C14. The present FM signal frequency is controlled by the controller using the BAND input signal 94 to vary the frequency of the VCO. The LEFT_CHANNEL audio input 90 and the RIGHT_CHAN- NEL audio input 92 are suitable coupled to the respective inputs on the FM transmitter IC 88.

Figure 8:
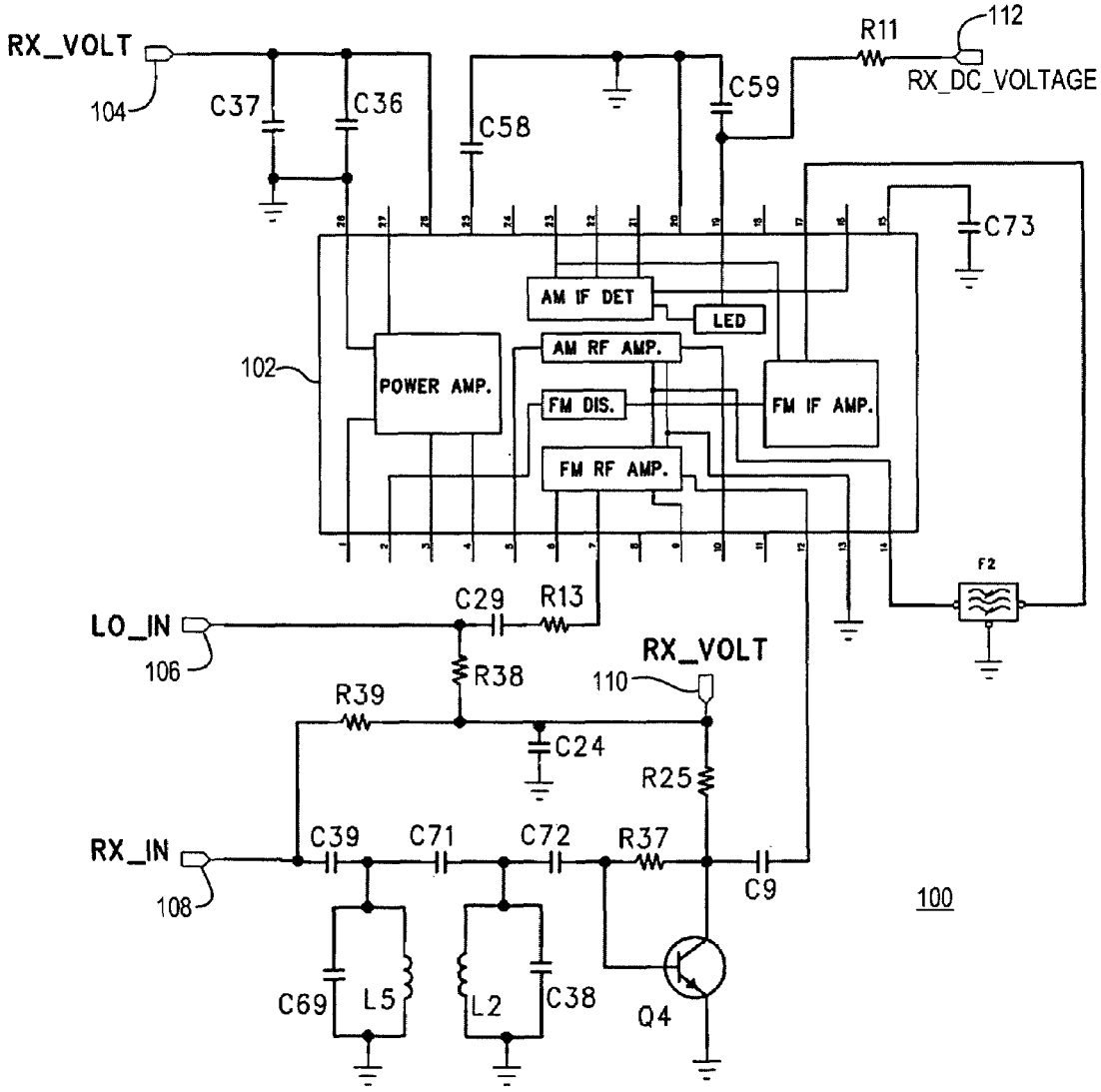
FIG. 8 is a schematic diagram of an FM demodulator circuit in a frequency scanning radio modulator according to an illustrative embodiment of the present invention.

Reference is directed to FIG. 8, which is a schematic diagram of an FM demodulator circuit 100 based on an integrated circuit device in a frequency scanning radio modulator according to an illustrative embodiment of the present invention. The embodiment in FIG. 8 employs an FM radio signal detection component designed around an FM radio demodulation IC 102, as are known to those skilled in the art. The FM demodulator 102 serves to measures the signal strength of a presently received radio signal. The received radio signal is coupled from the antenna (not shown) through the RX_IN input 108, and is then coupled through an L-C band-pass amplifier circuit, as are known to those skilled in the art, to the FM demodulator IC 102. The RF signal produced by the FM transmitter is coupled to the LO_IN input 106 to the local oscillator input of the FM demodulator IC 102. The LO_IN 106 and RX_IN 108 signals are mixed to discriminate a received frequency within the FM modulator IC 102. The output of the detector circuit of in the IC 102 is integrated and output as the RX_DC_VOLTAGE 112 signal, which is a DC voltage level corresponding to the received signal strength. The RX_DC_VOLTAGE signal 112 is applied to the controller, which stores, compares and selects a preferred present transmit frequency based thereon, and thusly, enables the circuit to avoid any interference from the local radio stations. Power to the FM demodulator is switched cy the controller using the RX_VOLT input 104, as is the power to the LC band-pass amplifier circuit using the second RX_VOLT input 110.

Figure 9:
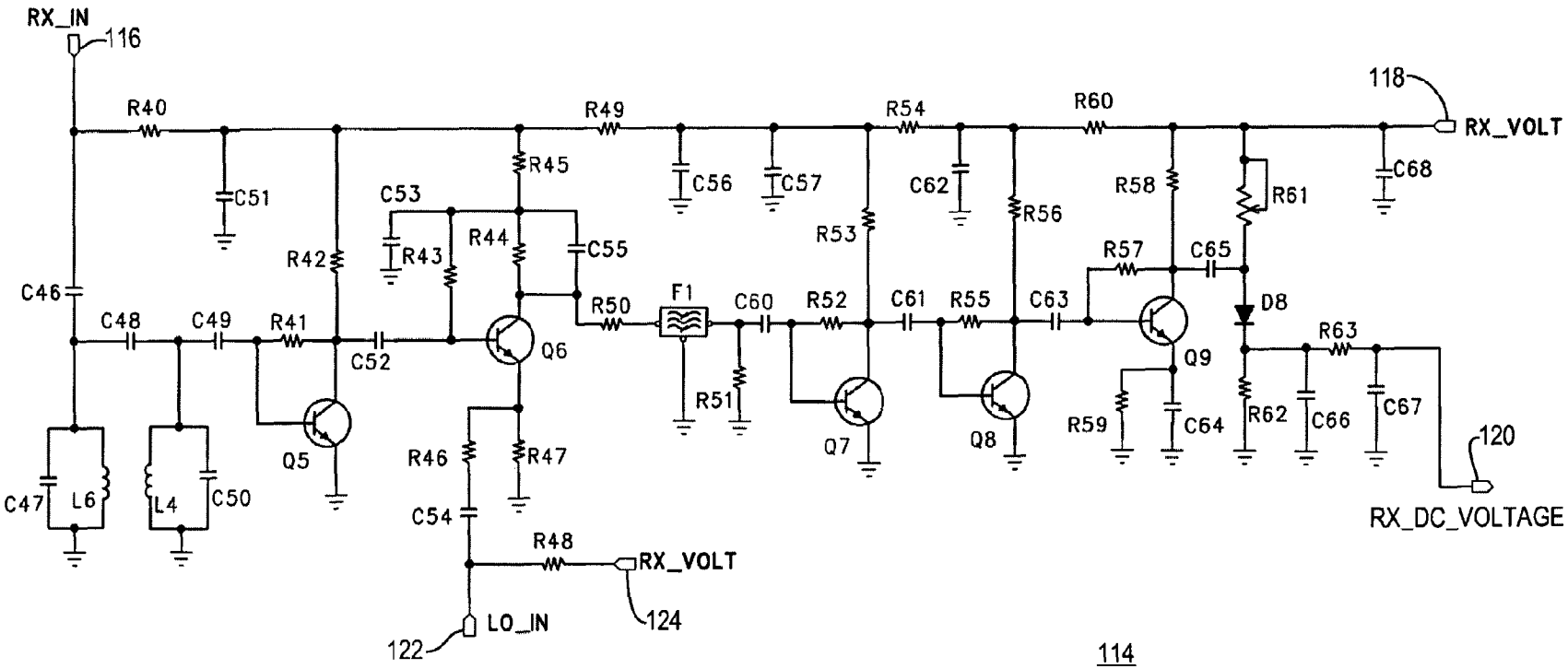
FIG. 9 is a schematic diagram of an FM demodulator circuit in a frequency scanning radio modulator according to an illustrative embodiment of the present invention.

Reference is directed to FIG. 9, which is a schematic diagram of an FM demodulator circuit 114 constructed using discrete devices in a frequency scanning radio modulator according to an illustrative embodiment of the present invention. The general circuit design and function are the same as for the integrated circuit arrangement of FIG. 8. In FIG. 9, the FM detector is replaced with discrete transistor circuit. The ambient radio signal is received by the antenna (not shown) and coupled to the RX_IN terminal 116. Power to the circuit is selectively controlled by the controller using the RX_VOLT terminal 118 and terminal 124. The received signal strength DC output voltage is provided at the RX_DC_VOLTAGE terminal 120. The RX_DC_VOLTAGE signal 120 is generated by combining the local oscillator signal LO_IN 122 from the FM transmitter RF signal and the antenna signal RX_IN 116. The RX_DC_VOLTAGE DC voltage generated is proportional to the signal strength of the received radio signal. The RX_DC_VOLTAGE signal 120 is applied to the controller, which stores, compares and selects a preferred present transmit frequency based thereon, and thusly, enables the circuit to avoid any interference from the local radio stations. In FIG. 9, the FM demodulator is implemented by discrete transistors Q4, Q5, Q6, Q7 and Q8, as will be appreciated by those skilled in the art.

Figure 10:
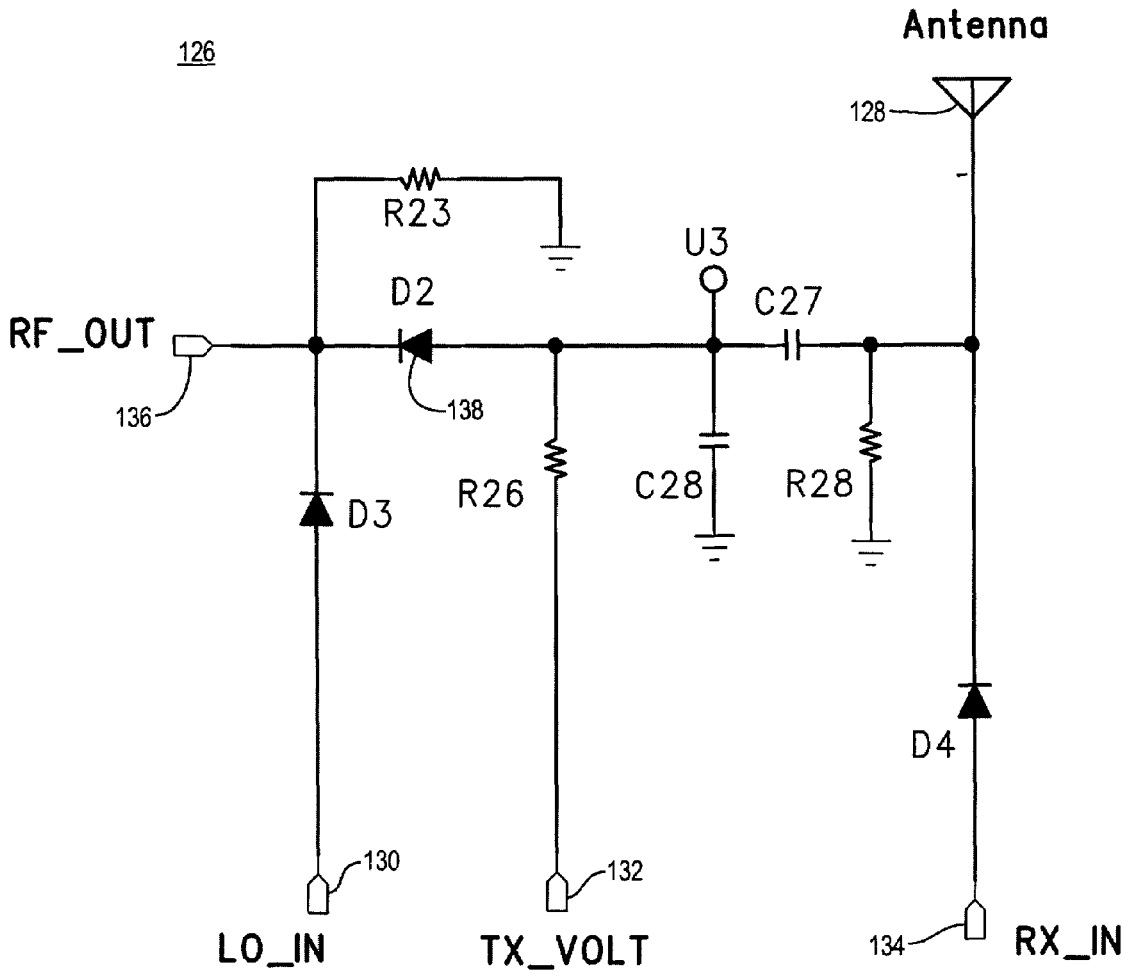
FIG. 10 is a schematic diagram of an antenna switch circuit in a frequency scanning radio modulator according to an illustrative embodiment of the present invention.

Reference is directed to FIG. 10, which is a schematic diagram of an antenna switch circuit 126 in a frequency scanning radio modulator according to an illustrative embodiment of the present invention. An antenna 128 is coupled to the RX_IN terminal 134 through diode D4. RX_IN 134 is coupled to the demodulator circuit discussed hereinbefore. The transmitted RF signal from the transmitter circuit is coupled to the RF_OUT terminal 136, which is coupled to the antenna 128 through diode D2 138. Diode D2 is forward biased and reverse biased through selective application of the TX_VOLT signal 132 by the controller. When operating in the receive scan mode of operation, the RF signal from the transmitter is coupled to the local oscillator input of the demodulator through the LO_IN terminal 130 of the antenna switch circuit 126.

Figure 11:
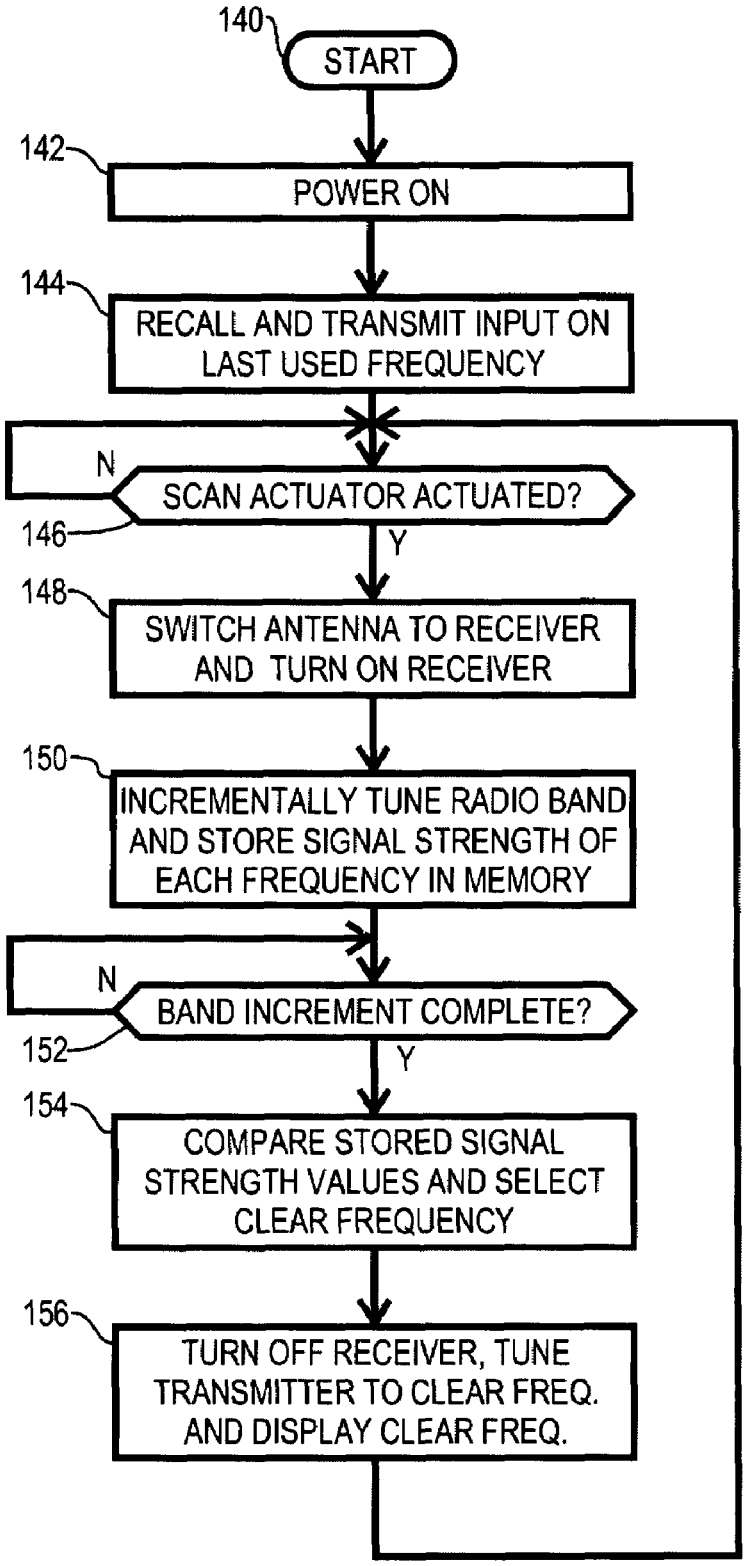
FIG. 11 is a process flow diagram in a frequency scanning radio modulator according to an illustrative embodiment of the present invention.

Reference is directed to FIG. 11, which is a process flow diagram in a frequency scanning radio modulator according to an illustrative embodiment of the present invention. The process starts at step 140 and proceeds to step 142 when power is applied thought the CLA adapter of the circuit. At step 144, the controller recalls the most recently stored present transmit frequency and sets the transmitter to this frequency of operation, and displays the frequency on the display. This step allows the user to continue using the apparatus without re-scanning each time power is applied. On the other hand, if the user actuates the scan actuator at step 146, the receive scan operation is commenced. At step 148, the antenna switch is decoupled from the transmitter, and the receive demodulator circuits are powered-up. At step 150, the controller incrementally tunes the receiver, by adjusting the local oscillator input frequency, across the entire FM radio band in 200 kHz steps. At each step, the signal strength DC voltage output from the FM demodulator is stored in the channel memory, indexed or addressed by the frequency. Once the band scan is complete at step 152, the comparison process is commenced at step 154. At step 154 the controller compares the stored signal strength levels and selects a low value, or the lowest value, indicating a channel with acceptable interference levels has been identified. At step 156, the controller turns off the FM demodulator, tunes the transmitter to the presently selected frequency, and displays that frequency on the display so that the user can tune his FM radio to the appropriate channel to receive the transmitted signal.

It will be appreciated that embodiments of the present invention described herein may be comprised of one or more conventional processors and unique stored program instructions that control the one or more processors to implement, in conjunction with certain non-processor circuits, some, most, or all of the functions described herein. The non-processor circuits may include, but are not limited to, a radio receiver, a radio transmitter, signal drivers, clock circuits, power source circuits, and user input devices. As such, these functions may be interpreted as steps of a method. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A radio modulator apparatus, having a radio band scan function, comprising:

a frequency selectable RF signal transmitter;

a switch that couples said RF signal to an antenna;

a demodulator coupled to mix a received antenna signal with said RF signal to produce an indicia of signal strength at the receive frequency resulting from the mix;

a channel memory coupled to store plural indicia of signal strength values corresponding to plural receive frequencies;

a controller coupled to said transmitter, said switch, said channel memory, and a display, and wherein said controller enables the frequency scan function by decoupling said switch, tuning said transmitter RF signal to plural frequencies, thereby causing said demodulator to receive plural receive frequencies within the radio band, and storing the resultant plural corresponding indicia of signal strength in said channel memory, and said controller compares said stored plural indicia of signal strength to select a present transmit frequency that has a low signal interfering level, couples said transmitter to said antenna, tunes said RF signal to said present transmit frequency, and displays said present transmit frequency on said display.

2. The apparatus of claim 1, further comprising:

an actuator coupled to said controller, and wherein actuation of said actuator initiates said frequency scan function.

3. The apparatus of claim 1, further comprising:

a demodulator power source switch coupled to said controller, and wherein said controller decouples power to said demodulator while said RF signal is coupled to said antenna.

4. The apparatus of claim 1 wherein the radio band is the commercial FM broadcast band, and wherein said controller sequentially tunes the entire FM broadcast band in 200 kHz increments.

5. The apparatus of claim 1 and wherein said indicia of signal strength is a DC voltage level proportional to said receive frequency signal level.

6. The apparatus of claim 1 and wherein said switch is a diode that is reverse-biased to decouple said RF signal from said antenna.

7. The apparatus of claim 1, further comprising:

an audio signal input coupled to provide a base band signal to said transmitter, and adapted to interface with a portable audio signal playing device.

8. The apparatus of claim 1, further comprising:

a power supply circuit having a power input connector, and coupled to provide electric power the radio modulator apparatus.

9. The apparatus of claim 8, and wherein said transmitter is supplied power continuously while said power input connector is couple to an external power supply.

10. The apparatus of claim 8, further comprising:

an audio signal input, with an input connector, coupled to provide a base band signal to said transmitter, and wherein said power supply circuit couples operating power through said input connector, for use in powering a portable audio player connected to said input connector.

11. A method of scanning a radio band using a radio modulator having a frequency selectable RF signal transmitter, an antenna, a demodulator, a display, and a channel memory, the method comprising the steps of:

scanning plural receive frequencies in the radio band by;

decoupling the RF signal from the antenna;

tuning the RF signal transmitter to plural frequencies;

mixing a received antenna signal with each of said plural RF signal frequencies in the demodulator, and producing an indicia of signal strength at each of plural receive frequencies resulting from said mixing;

storing said plural indicia of signal strength in the channel memory at locations corresponding to plural receive frequencies, and selecting a present transmit frequency from amongst said plural receive frequencies by;

comparing said stored plural indicia of signal strengths;

selecting one of said plural receive frequencies, based on a low stored indicia of signal strength, as a present transmit frequency, and enabling said present transmit frequency by;

coupling the RF signal to the antenna;

tuning the RF signal transmitter to said present transmit frequency, and displaying said present transmit frequency.

12. The method of claim 11, further comprising the step of:

actuating an actuator to manually initiate said scanning, selecting and enabling steps.

13. The method of claim 11, further comprising the steps of:

connecting power to the demodulator in preparation for said scanning sequence, and disconnecting power from the demodulator in preparation for said enabling sequence.

14. The method of claim 11 wherein the radio band is the FM broadcast band, and wherein said tuning the RF signal transmitter to plural frequencies includes sequentially tuning entire FM broadcast band in 200 kHz increments.

15. The method of claim 11 and wherein the indicia of signal strength is a DC voltage level proportional to the receive frequency signal level.

16. The method of claim 11, further comprising the step of:

manually selecting said present transmit frequency.

17. The method of claim 11, further comprising the step of:

maintaining electrical power to the RF signal transmitter during all of the foregoing method steps.

* * * * *